US007402737B2

(12) United States Patent
Kerly

(10) Patent No.: US 7,402,737 B2
(45) Date of Patent: Jul. 22, 2008

(54) TREATED MUSICAL INSTRUMENT STRINGS

(76) Inventor: Sean Kerly, 78 Logan Ave., Jersey City, NJ (US) 07306

( * ) Notice: Subject to any disclaimer, the term of this patent is extended or adjusted under 35 U.S.C. 154(b) by 109 days.

(21) Appl. No.: 11/069,192

(22) Filed: Mar. 1, 2005

(65) Prior Publication Data

US 2006/0196339 A1 Sep. 7, 2006

(51) Int. Cl.
*G10D 3/10* (2006.01)

(52) U.S. Cl. ..... 84/297 S; 62/62

(58) Field of Classification Search ..... 84/297 R, 84/297 S; 62/62, 78, 457.9
See application file for complete search history.

(56) References Cited

U.S. PATENT DOCUMENTS

| | | | | |
|---|---|---|---|---|
| 4,042,421 | A * | 8/1977 | Van Den Sype et al. | 148/578 |
| 6,348,646 | B1 | 2/2002 | Parker et al. | |
| 2004/0255751 | A1 * | 12/2004 | Schlesinger | 84/297 S |

* cited by examiner

*Primary Examiner*—Lincoln Donovan
*Assistant Examiner*—Jianchun Qin
(74) *Attorney, Agent, or Firm*—Bradley N. Ruben

(57) ABSTRACT

A treated musical instrument string which has undergone the physical and chemical restructure of Cryogenic Thermal Cycling process to improve tonality and durability which is only achieved by combining both Cryogenic Thermal Cycling process and specially formulated coatings.

13 Claims, 1 Drawing Sheet

TREATED MUSICAL INSTRUMENT STRINGS

CROSS-REFERENCE TO RELATED APPLICATION

NA

STATEMENT REGARDING FEDERALLY SPONSORED RESEARCH OR DEVELOPMENT

Not applicable

REFERENCE TO SEQUENCE LISTING

Not applicable

BACKGROUND OF THE INVENTION

1. Field of the Invention

This invention relates to musical instrument strings and particularly to through the treatment of cryogenic thermal cycling process This method for the manufacture of musical instrument strings addresses extended useful life of said strings and improvement of it's tonality through the application of both the treatment of the Cryogenic Thermal Cycling Process*, (* henceforth known as: CTCP), in addition to specially formulated coatings.

Conventionally, musicians have to deal with both the short optimal tonal life of their strings, as well as string breakage at inopportune moments such as during live performance. The major causes of these problems being the friction at point of string contact on the instrument body, "wear and tear" of the string through both vibrations and tensile changes from both playing and tuning, degradation in quality from environmental factors such as moisture, (including perspiration from digits of the player as well as ambient moisture or humidity) and oxidation, and normal deviations from structural perfection inherent in manufacturing of any similar metal product; such as microscopic "hills and valleys", micro cracks or other such imperfections that increase friction and/or string breakage. All factors combine to the dwindling of the useful life of the string.

Although various products have been introduced throughout the years to address some of these issues, no one has been successful in addressing them all, as well as simultaneously improving upon tonality. Using the guitar as an example; please note the following.

Stringed instruments all need the string to come into contact with the instrument body in order to transmit the vibrations created by various methods of plucking the string in order to create the sound finally audible to the human ear. It is at these points that the stresses invariably produced in the movement created by the plucking occur, and begin they incur on the useful life of the string.

The point of contact on a guitar is known as a "saddle". Conventionally manufactured of metal, such as pressed steel, brass, or stainless steel, each string has to bend at this point of contact. Although new developments such as "rollers", (primarily a tuning aid), or saddles coated with various lubricants have come forth in the market place, they have offered minimal, if any change in the length of useful string life. One manufacturer, Fender, attempted to create a stronger musical string by applying a wrapping that acted to improve tensile strength and relieve occasion of breakage by applying yet another substance wound around a "normal" string. Unfortunately it was found to "deaden " the tone to such an extent as to be deemed unworthy of production. Some require excessive work in time and cost, or modification to the instrument to attach to the instrument body prior to use. None show appreciable progress in lessening occasions of string breakage, let alone improvement of sound or tonal qualities.

Furthermore, the average guitar string, as manufactured today, is subject to all problems existent in any product whose main component is a metal with tensile properties. There are microscopic pits and indentations as well as micro cracks, as mentioned above. Although invisible to the naked eye, in most cases, as a string is placed under increasing tensile pressure, these minor deformities become a major source of increased friction or may cause micro cracks to increase in size or severity.

2. Prior Art

U.S. Pat. No. 4,539,228 The microscopic pores, cavities, and crevices of the strings and the interstices of a wound string are filled with dry film lubricant particles using a moisture displacing agent and rust inhibitor as a carrier for the dry lubricant. This provides lubrication and inhibits corrosion, thus shortening initial break in periods and extending string life. Our invention uses cryogenic thermal cycling to obtain the enhanced properties of inhibiting corrosion and extending tonality and durability of the said string. In addition, the use of the coating process in our invention is applied only at the point where the strings rest over a device known as the "saddle" durability reasons. Our process involves spraying and baking the coatings at 350° F. for 10 minutes, the above patent soaks their strings to allow the coating of choice to penetrate the micro cracks of the string.

U.S. Pat. No. 4,960,027—This patent is not for a string, or string enhancement, rather a saddle/bridge enhancement which the claims lead to string durability or less breakage. This is relative to the coating portion of our invention. This patent discusses the use of dry film lubricants to change the surface of the substrate of the saddle/bridge of the guitar, not the string as with our invention. Our patent is the opposite premise, the strings is coated with the dry film lubricant material at the point of contact between the string and saddle.

U.S. Pat. No. 5,801,319—This patent's claims center around coatings being used to counteract corrosion and obtaining an ease of playing, better tonality and intonation. Our invention uses cryogenic thermal cycling to obtain enhanced corrosive properties, tonality and durability. This patent does not make durability claims with the use of their coating process. This patent's claims refer to coating the entire string with a tube and various coatings to achieve their claims, our invention using cryogenic thermal cycling changes the molecular structure of the metal, without coating the entire string, to achieve the results of our claims. Our coating process concentrates coating with our spraying/curing method at the point of contact where the string rests on the device known as the "saddle", whereas this patent coats the entire string. Our invention uses coating on all 6 strings, both wound and unwound, whereas this patent coats only the wound strings. Between the two inventions, there are different application methods and material choices that set our patents apart.

FIG. 1 illustrates a conventional classical guitar 10. Conventional classical guitars include a "fret" or "fingering board" 12, across which multiple strings, 14*a*, 14*b*, 14*c*, 16*a*, 16*b*, and 16*c*, are strung and against which the strings are pressed to form different notes as the strings are picked or plucked. A typical classical guitar includes three relatively "high" note (or "treble") strings, 14*a*, 14*b*, 14*c*, and three relatively "low" note (or "bass") strings, 16*a*, 16*b*, 16*c*. The strings are strung from the bridge 11 along the fretboard to the tuning keys 13. High note strings 14*a/b/c* are generally formed from a straight "nonwound" material, such as gut, synthetic material, or metal, as the core 21 is seen in FIG. 2. Low note strings 16*a/b/c* are often formed from a wound string, and FIG. 2 shows a metal core having a wire winding, three such turns (21*a/b/c*) being shown in FIG. 2.

SUMMARY OF THE INVENTION

The invention provides an improved string for stringed instruments through several components. The components being lengthening of useful string life as well as improved string performance through improved tonality. This is performed in aggregate, first by treatment with the CTCP, explained in detail further on, and further by combining this with the addition of specially formulated lubricants directly to the treated string at point of instrument body contact/stressors. The CTCP actually has multiple benefits, and also affects the second component, being that it adds to the tensile strength as well as improving adhesion of the lubricant/anti-wear coatings. Finally, in a process explained below, the CTCP also improves the tonal qualities of the finished string, this being the third and final component.

Being the major factor in the initial component the CTCP subjects the string, (or other articles), to extreme negative temperatures, thereafter cycling the article between a set of negative temperatures for a number of cycles. The process is completed by heating the article to an extreme positive temperature and then allowing it to cool to ambient room temperature. The process strengthens the article by realigning its molecular structure to eliminate micro-cracking and other manufacturing deforming characteristics.

In U.S. Pat. No. 6,332,325, The inventor of CTCP explains," as energy is dissipated through an article of manufacture, it passes from molecule to molecule causing vibration in the article. Over time, this vibration weakens the article, resulting in premature wear. Depending on the article, especially those of a metal based molecular structure, and the force being exerted upon it, this premature vibration can be costly and in some instances dangerous. For example, a prematurely worn saw blade can splinter or explode and cause harm to any user or person in close proximity of the exploding blade. It is therefore advantageous to strengthen these articles through molecular transformation or the "bringing together" of the molecules. The concept is to strengthen the article of manufacture by bringing the molecules closer to one another to particulate the molecular structure into smaller micro-structures thereby reducing vibration by creating a more direct path for the dissipating energy. This is especially important in metal articles of manufacture", as these vibrations are the major source of wear in metal articles, especially true of something regularly plucked such as a guitar string. According to information provided by the patent holder the "germ" of the process is that the "process causes any soft Austenite, (a major component of all metals), retained after heat treatment to transform to hard Martensite. The results, your metals will last longer increasing your part's life up to 600%" The patent goes as far as to specifically mention musical instruments stating, "The end result (of the C.T.C.P.) is a superior metal article of manufacture. Examples of superior metal articles include musical instruments whose tonal quality is improved, strengthened golf club heads which can exert greater force upon a golf ball when it is struck, vehicle components and cutting tools which wear at a slower vibration degradation rate . . . "

Deduced from the explanatory excerpt quoted above, while the author is speaking about the actual instrument body, it would logically carry over that a string so treated is not only going to have a longer useful life even before egress of the package, but will have a longer life by dissipating the vibrations produced from the plucking of the strings during playing of the instrument in a more efficient manner than an untreated string.

Also of note about this process, in U.S. Pat. No. 6,332,325, as a component in this C.T.C.P. process is that "prior art processes merely treated the outer surface of the metal article. In other words, these prior art processes fail to treat the entire molecular mass of the metal article. Accordingly, articles treated with the prior art processes cease to be effective after the surface of the metal article has worn away." Therefore, we may assume that any improvement in tonality created by subjecting musical instrument strings to this manufacturing process may be assumed to be present for the entire life of the string, not merely a portion of it's useful life, and will also defray, or completely negate the "period of break-in" often described by professional musicians. This period includes the need to constantly re-tune a new set of strings until they are sufficiently stretched to hold the desired tension, (stay in tune) for a "reasonable" period, (e.g. an entire performance of a group of songs known as "a set" among professional musicians), before needing to be tuned yet again. It is obviously more convenient to know that if one has to change a broken string during a performance that the person can initially tune the string to the desired tension and know that it will maintain this measure of tension for more than a few minutes or seconds.

The C.T.C.P. process lengthens the useful life of the string "on both ends" by reducing or eliminating the initial string "break in" period, (stretching during tuning process), also maintaining proper tuning for a longer period and simply increasing string life overall. All functions of major importance as any performing musician will iterate.

The C.T.C.P. process, as an added benefit, leaves the treated metal absolutely clean, thereby allowing for any outside addendum or coating, such a coating of lubricant. The average musician is aware, too, that accumulated dirt and debris contribute to "deadening" of strings tonal qualities, shortening its life. By leaving the metal both absent of pits, micro cracks and left free of dirt or debris, the string is less apt to accumulate dirt, dust and debris in general, thereby making it easier to clean.

This brings us to another component of our product. The introduction of a dry film lubricant applied to the string at points of highest stress.

As mentioned earlier in our application, using a guitar as our example(s), the point of highest stress is where the string comes into contact with the "saddle". The saddle is placed directly above the sound hole. There are holes in the saddle to slide the string through. A metal ring, larger in diameter than the hole in the saddle holds the string in place. After running through the hole of the instrument body and through the saddle, the string then bends directly onto the top of the saddle, over the "fret board", where the required notes are played through correct finger placement, finally reaching the "tuning pegs" on the far end of the fret board. The string is wound around the tuning pegs allowing the player to tune the instrument by turning the peg to allow more or less tension to the string in order to "tune" the instrument.

Made of several materials, usually steel or brass, however, it is at the saddle where the string has to provide tension, creating much friction at this particular point. When the string is plucked, it is this point of contact that moves or vibrates causing the most wear on the string. Already having improved the tensile strength of the string with the C.T.C.P. process, a coating of selected dry film lubricants is applied along the corridor of the string coming into contact with the saddle to further extend its useful life. The lubricant provides a bed of a slick and malleable substance, Teflon (registered trademark of DuPont), to create an area for the string to move about freely, with as little friction as possible being created between the string and the saddle upon the plucking of the string.

While the inventor chooses to use Teflon to the above effect, other products similar in nature, (e.g. graphite, molybdenum disulphide), may be substituted to however there are various differences of coefficient of friction levels, the rate of movement between the two objects. While other similarly coated guitar strings are under patent (e.g. U.S. Pat. No. 6,528,709, Hebestreit, et al., Mar. 4, 2003), and claim to resist corrosion and maintain the lively sound of the string, our intent is to use the coatings to further resist breakage and wear in conjunction with and above and beyond the CTCP process. Furthermore, other existing patents where polymer coatings are used to resist corrosion, etc, the lower pitched strings or "wound" strings are only treated. Wound strings refer to a wrapped wire around a core wire that produce the lower tones on the guitar, unwound strings do not have a wrapped wire around the core and therefore produce higher pitched tones. Whereas, the current process treats both wound and unwound strings.

The Teflon coating is applied in the following manner. The now CTPC strings are placed a fixture exposing the last 2-⅜" of the string. The coating is sprayed on the product from all sides to obtain a uniform coating of the string. They are then cured by method of heat treatment by placing them beneath specifically created heat lamps that apply heat at 325 degrees F. Directly to the desired, (coated) area of the string for a period of 10 minutes. The curing process is necessary for the purposes of adherence and having the dry film lubricant Teflon coating rise to the surface to create the desired effect in the coating.

DETAILED DESCRIPTION OF THE INVENTION

Figure 1:
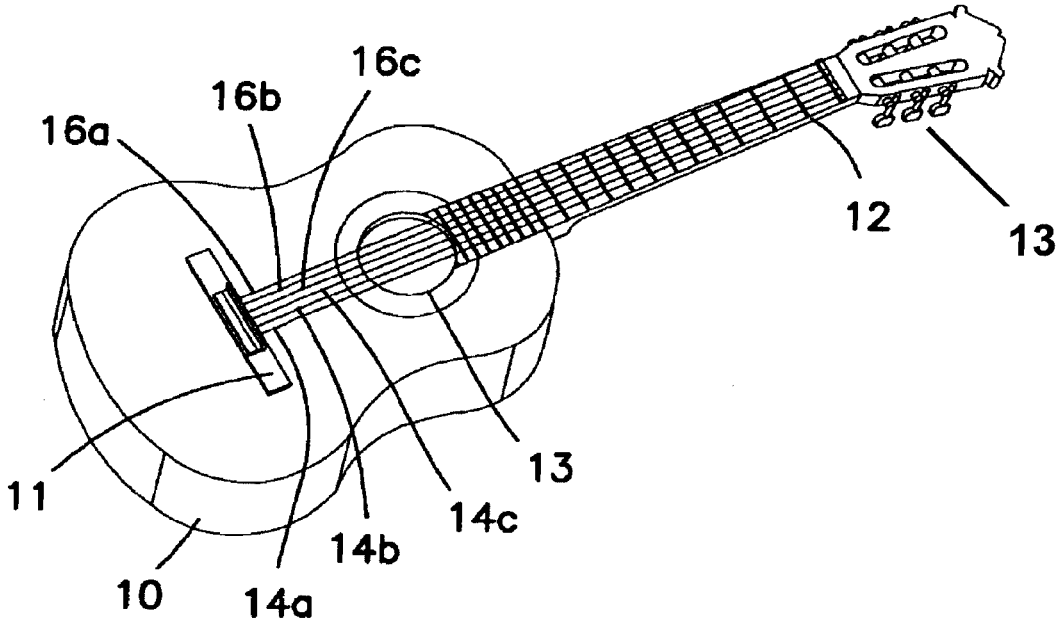
FIG. 1 (Prior Art)
FIG. 1 is an idealized depiction of a prior art classical guitar.
Figure 2:
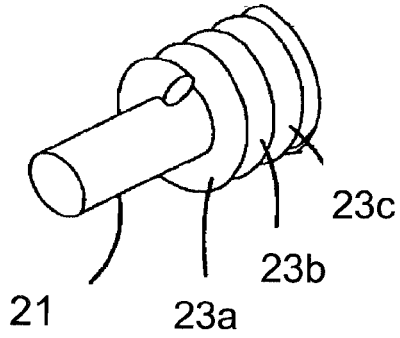
Fig. 2 (Prior Art)
FIG. 2 is an idealized partial cross section of a wound string.

The invention begins with an untreated guitar string. While manufactured from many different materials, e.g. steel, nickel wound steel, ferrous and the like, at time of application the inventor uses nickel wound steel for the three lower tonality strings and steel, alone, for the three upper register strings. This six string configuration is the usual number of strings. In recent times, however, some manufactures use seven or more strings to create a basis to play a greater number of notes. No matter, the process is the same.

Once obtained, the strings are sent out to undergo the Cold fire Thermal Cycling Process, (CTCP). A process patented under U.S. Pat. No. 6,332,325 the process, by using state of the art machines, subjects the metal in the strings to a metal tempering cryogenic process treatment that exposes the metal to sub-zero and hot temperatures over and over again within a twenty four hour period. This process causes any soft Austenite retained after heat treatment to transform to hard Martenite. This results into an increase on average of 200-300%, up to 600% in the life of the metal object.

Depending on the results being sought the metal product is cycled between 12 and 24 hours at temperatures varying from −320 degrees F. and back up to +350 degrees F. eliminating any type of thermal shock.

Not merely a surface treatment, the process affects the entire mass of the product being treated. This means it works for the entire life of the product, not merely until the surface layer is worn away.

The process works by rearranging the molecular structure of the metal. During CTCP, the micro-structure begins to particulate into smaller, regular micro-structures. The Thermal processed metal allows the passage of energy to be direct, eliminating vibration, the main cause of metal fatigue.

The molecular structure is inverted from a concave form to a convex form. This fills lots of voids and gaps, (e.g. micro cracks in the surface of a guitar string); on a microscopic level making the part denser without changing it's weight or hardness. While not making the mass harder, the other improvements mean a more durable and longer life product. A more dense formation allows sound waves or vibration to pass through the metal creating less vibration in its state of matter, thus a lessening of the major cause of fatigue or failure in this type of musical string product. The filling of micro cracks makes for a smoother and more durable surface also lengthening the life of the product.

To measure the increase in tensile strength and string life claimed by the patent holder of the CTCP process, the following bench test was created. A guitar pick was attached to a rotating mechanical arm to simulate the picking of a guitar string by a musician. A guitar string, treated and untreated with the CTCP both, and then untreated and treated with CTCP and a Teflon coating were similarly attached to clamps simulating a string at average tensile strength to a tuned guitar string when on an actual musical instrument. The arm was set to rotate at 400 "Plucks per minute", (pl.p.m.) As can be seen in the accompanying printed test analysis, the increase in time before string breakage was further increased by the addition of each step in the manufacturing process as herein described.

This change in molecular structure obviously leads to a change in tonal properties since the process changes the structure of the entire mass of the string, not merely the exterior. Because the rate of vibration is different there is a change into what has been described by a majority of listeners as a "crisper" sound. This translates to a sound where more treble or high pitched tones are heard.

Following the CTCP, the string is ready to be coated by applying Teflon, on average 0.5-1 mil in thickness at the ball end of the string covering the first 2-⅜ ths inch of the string nearest the ball. The ball being the piece that holds one end of the string in place beneath the saddle. Since there are various dimensions between the ball end of the string and the contact with the saddle, however, an average of 2-⅜ ths inch additional coating can be applied to effectively produce the lubrication properties for instruments with a longer distance between the ball end and point of string contact with the saddle.

This result was achieved by coating strings with Teflon at various levels of thickness. Levels of 0.5, 1.0 And 1.5 mil were all tried. After testing the strings through an amplified system with professional musicians it was realized that a coating between 0.5 and 1.0 mil was sufficient to achieve the desired result without affecting, or deadening, the tonality of the string in any way.

Although other coatings were tried, (e.g. graphite, Molybdenum Disulphide), Teflon was chosen because it evinced the following properties. It provided better adherence, and Teflon is specifically manufactured for low load repetitive stresses.

The graphite had the undesirable effect of rubbing off the players hands and the Molybdenum Disulphide required a greater bearing start load than is normally struck in the act of normal string plucking before it reaches optimum effective lubrication levels. Various teflon coatings were tried, both heat cure and air dry sytems, the selected heat cure teflon coating which includes a priming agent with the teflon topcoat was the desired choice. This heat cure coating selection with the added priming agent produced a higher quality adherence and eliminated the step of a separate priming procedure. Air dry systems did not meet the same adherence results and with the extra priming step led to a longer process time. The seperate addition of a primer added more of a coating thickness reaching up to 2 mil in thickness to the substrate which produced negative tonal properties. A heat cure topcoat with an adhesion primer also ads an additional benefit to the winded end of the string which is found on the "ball end". A circular ring which is call the "Ball end" is used so the string can be looped through this whole and wound during the string production process. By adding the selected coating, the adhesive properties of the primer/topcoat system also tightly grips the winding to the "ball end" and improves the strength at this point which has also been show to lead to premature string breakage and tuning problems In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting.

It is therefore an object of the present invention to provide a treated musical instrument string apparatus and method which has many of the advantages of the closures mentioned heretofore and many novel features that result in a planting device which is not anticipated, rendered obvious, suggested, or even implied by any of the prior art tool guides, either alone or in any combination thereof.

It is another object of the present invention to provide a treated musical instrument string apparatus which may be easily and efficiently manufactured and marketed.

It is a further object of the present invention to provide a planting device which is of a durable and reliable construction.

An even further object of the present invention is to provide a treated musical instrument string apparatus which is susceptible of a low cost of manufacture with regard to both materials and labor, and which accordingly is then susceptible of low prices of sale to the consuming public, thereby making such planting device economically available to the buying public.

Still yet another object of the present invention is to provide a treated musical instrument string apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying descriptive matter in which there are preferred embodiments of the invention While I have described but a few embodiments of the invention, it will be apparent to those skilled in the art that the invention may be embodied still otherwise without departing from the spirit and scope of the invention.

Having thus described the invention, what is desired to be secured by a Patent is:

1. A metal musical instrument string for a stringed musical instrument, said string having been subjected to thermal cycling between cryogenic and temperatures with respect to ambient for a plurality of cycles, without deformation or coating of said string during said cycling, effective to increase the strength and durability of said musical instrument string.

2. The string of claim 1, wherein said string is a reinforced string.

3. The string of claim 1, wherein the string is wound.

4. The string of claim 1, wherein the string is unwound.

5. The string of claim 1, wherein the tonality of the string is improved from that existing prior to said cryogenic thermal cycling.

6. An improved metal musical instrument string for a stringed musical instrument produced by the process of providing a metal string for a stringed musical instrument and subjecting said string to thermal cycling between cryogenic and heated temperatures with respect to ambient for a plurality of cycles, without deforming or coating said string during said cycling, effective to increase the strength and durability of said musical instrument string.

7. The string of claim 6, wherein said string is a reinforced string.

8. The string of claim 6, wherein the string is wound.

9. The string of claim 6, wherein the string is unwound.

10. The string of claim 6, wherein the tonality of the string is improved from its state prior to said cryogenic thermal cycling.

11. The string of claim 6 in combination with a stringed musical instrument wherein said string is installed in said instrument.

12. A stringed musical instrument comprising at least one metal string having been subjected to thermal cycling between a, cryogenic temperature and a heated temperature for a plurality of cycles without deforming or coating said string during said thermal cycling, said cycling being effective to increase the strength and durability of the string.

13. A method of assembling a stringed musical instrument for use by providing the instrument and installing at least one metal string functionally thereon, wherein the improvement comprises installing at least one metal string that has been subjected to thermal cycling between cryogenic and heated temperatures for a plurality of cycles, without deforming or coating the string during the cycling, effective to increase the strength and durability of the string.

* * * * *